United States Patent [19]

Peterson et al.

[11] 4,198,915

[45] Apr. 22, 1980

[54] VACUUM-TYPE PNEUMATIC NEEDLE THREADING ASSIST

[75] Inventors: Wesley R. Peterson, Bound Brook; Robert Sedlatschek, Bridgewater; James A. Transue, Union; Peter J. Totino, North Bergen, all of N.J.

[73] Assignee: The Singer Company, Stamford, Conn.

[21] Appl. No.: 948,930

[22] Filed: Oct. 5, 1978

[51] Int. Cl.[2] ..... D05B 87/00

[52] U.S. Cl. ..... 112/225

[58] Field of Search ..... 112/225, DIG. 1, DIG. 2, 112/DIG. 3; 223/99

[56] References Cited

U.S. PATENT DOCUMENTS 571,818 11/1896 Willcox ..... 112/225

3,486,472 12/1969 Kaplan ..... 112/225

3,599,587 8/1971 Greulich ..... 112/225

FOREIGN PATENT DOCUMENTS 593660 10/1947 United Kingdom ..... 112/225

*Primary Examiner*—Werner H. Schroeder

*Assistant Examiner*—Andrew M. Falik

*Attorney, Agent, or Firm*—Edward J. Bell; Robert E. Smith

[57] ABSTRACT

A pneumatic needle threading assist is disclosed which has a thread collecting chamber in which, due to the air flow therethrough, thread having passed through the eye of a sewing needle, is therein deposited in a series of spiral loops limiting the amount of thread in the vacuum line and preventing the vacuum source from being contaminated with the thread.

2 Claims, 4 Drawing Figures

Fig.1
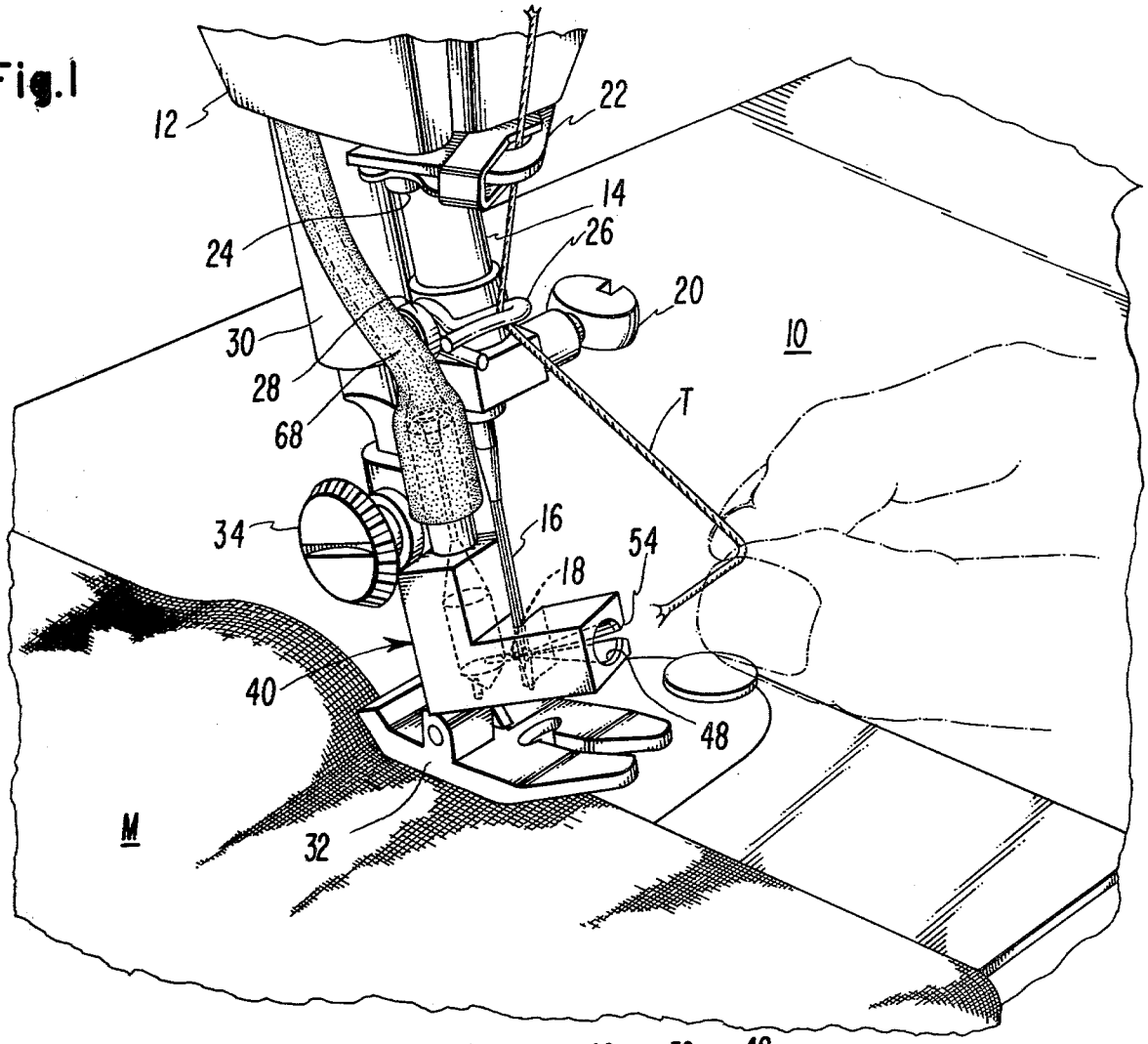
Fig.2
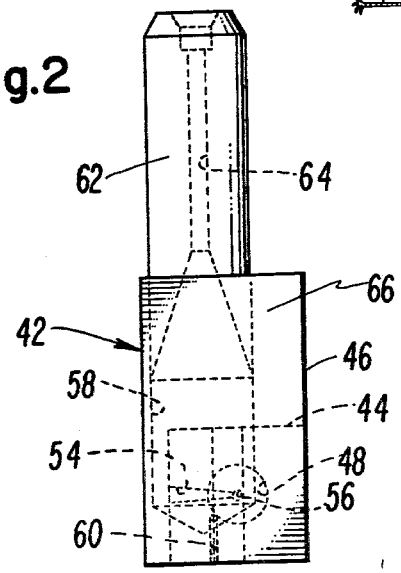
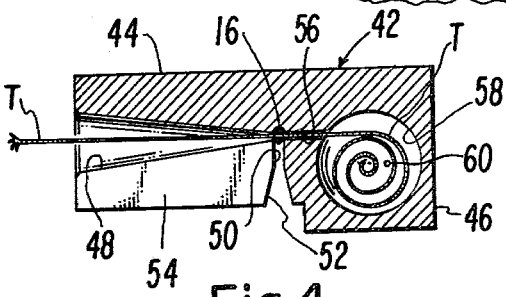
Fig.4
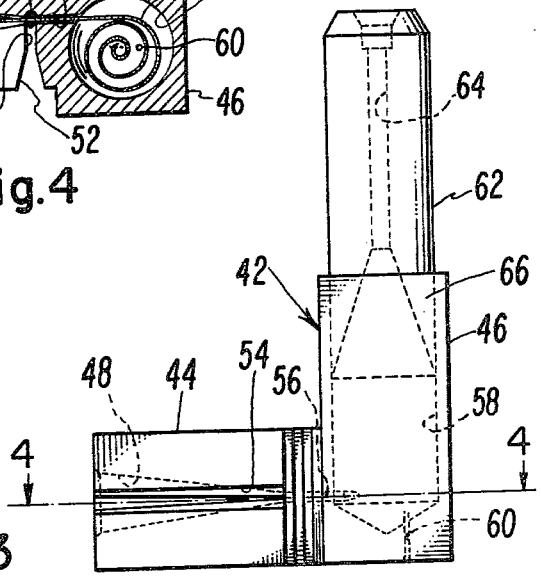
Fig.3

VACUUM-TYPE PNEUMATIC NEEDLE THREADING ASSIST

BACKGROUND OF THE INVENTION

This invention relates to needle threaders and, in particular, to pneumatic needle threading assists.

Noting how tedious threading of a sewing needle may be, there are many needle threading assists available for aiding the operator in performing this function. Of these types, pneumatic needle threading assists use air pressure (or vacuum) to urge the thread end through the needle eye. With respect to the vacuum type, the thread, upon passing through the needle eye, travels up through the vacuum line. This allows lint to accumulate in the line and also in the vacuum source which may cause failure of the same.

SUMMARY OF THE INVENTION

The object of this invention is to provide a vacuum type needle threading assist which minimizes the accumulation of lint and bits of thread in the vacuum line and the vacuum source.

This object is achieved in a pneumatic needle threading assist having means for receiving a sewing needle into the needle threading assist, means for guiding the end of a thread supply to the needle eye, means for supplying an air vacuum to the needle threading assist for urging the end of the thread supply through the needle eye, and means for collecting a quantity of the thread supply therein having passed through the needle eye, in advance of the air vacuum supplying means, whereby the thread will not collect in the vacuum supplying means.

DESCRIPTION OF THE DRAWINGS

With the above and additional objects and advantages in mind as will hereinafter appear, the invention will be described with reference to the drawings of a preferred embodiment in which:

FIG. 1 is a perspective view of the invention being used to thread a sewing machine needle;

FIG. 2 is a rear elevational view of the invention;

FIG. 3 is a side elevational view of the invention; and

FIG. 4 is a cross-sectional view of the invention taken along the line 4—4 of FIG. 3.

DESCRIPTION OF THE PREFERRED EMBODIMENT

A sewing machine is partially illustrated in FIG. 1 and includes a bed 10 and a sewing head 12. A needle bar 14 is carried within the sewing head 12 and is arranged therein for reciprocatory motion. A sewing needle 16, having a thread receiving eye 18 formed therein, is clamped to an end of the needle bar 14 by a needle clamp 20. A first thread 22 is shown attached to the sewing head 12 with a screw 24 and a second thread guide 26 is shown attached to the needle bar 14 adjacent the needle clamp 20 with a screw 28. The thread guides 22 and 24 guide thread T from a thread supply (not shown) to the eye 18 of the needle 16.

A downwardly biased presser bar 30 is also carried in the sewing head 12 and has a presser foot 32 attached to an end thereof with a screw clamp 34. The presser bar 30 and the presser foot 32 urge a material M being sewn into engagement with a feed mechanism (not shown) carried within the sewing machine bed 10.

In FIG. 1, a pneumatic needle threading assist 40 is shown in threading engagement with the needle 16. As clearly shown in FIG. 2, 3 and 4 needle threading assist 40 includes an "L" shaped housing 42 having a first section 44 and a second section 46, joined at one end thereof, to one end of the first section 44 and having the axis thereof perpendicular to the axis of the first section 42. A conical thread guiding aperture 48 is axially formed in the first section 44 and tapers inwardly toward the second section 46 of the housing 42. A needle receiving slot 50 is formed in the first section 44 adjacent the second section 46 in a plane substantially normal to the axis of the first section 44. The needle slot 50 intersects the conical aperture, effectively terminating the conical aperture 48, and is formed with a lead in taper 52 to aid in the insertion of the sewing needle 16. At the intersection of the conical aperture 48 and the needle slot 50, the size of the conical aperture 48 is substantially the same as the size of the needle eye 18. A groove 54 is formed in the first section 44 of the housing 42 parallel to the axis thereof and intersects the conical aperture 48 along the entire length thereof, the purpose for which will be explained later.

The second section 46 is formed with a thread orifice 56 which intersects the needle slot 50. The orifice 56 is coaxial with the conical aperture 48 in the first section 44 and has a size substantially the same as the conical aperture 48 at the intersection thereof with the needle slot 50. The second section 46 is further formed with a cylindrical thread chamber 58 extending through the free end thereof having an axis substantially parallel to the axis of the second section 46. The orifice 56 extends inwardly to intersect the chamber 58 tangentially. A bleeder orifice 60, having a diameter substantially smaller than the thread orifice 56, is formed in the second section 46 and extends from the bottom of the thread chamber 58 through the housing second section 46 along an axis substantially parallel to the axis of the second section 46.

A rod 62 is provided for introducing an air vacuum to the needle threading assist 40. To this end, the rod 62 is formed with an axial aperture 64 therethrough. At one end 66 of the rod 62, the aperture 64 is conically formed with an opening substantially the same as the diameter of the thread chamber 58. The rod 62, which also has an overall diameter the same as the diameter of the thread chamber 58 is fitted within the end of the thread chamber 58 and is secured to the second section 46 of the housing 42 by any suitable means such as brazing. A vacuum hose 68 is attached to the exposed end of the rod 62 and terminates at a vacuum source (not shown).

In operation, the needle threading assist 40 is brought to the sewing needle 16 such that the needle receiving slot 50 embraces the needle 16 and the conical aperture 48 is manually aligned with the needle eye 18. The vacuum source is then activated causing air to be drawn through the needle eye. Thread T is then inserted into the conical aperture 48, as shown in FIG. 1, and is allowed to be drawn through the needle eye, through the thread orifice 56 and into the thread chamber 58. Due to the tangential intersection of the thread orifice 56 with the thread chamber 58, the thread T is caused to swirl within the thread chamber 58 (see FIG. 4). Air entering through the bleeder orifice 60 urges the entering thread T upwardly allowing a significant quantity of the thread T to enter and spirally collect in the thread chamber 58. At this point, the vacuum source is deactivated and the needle threading assist 40 is removed from the needle 16 and placed in an area remote to the sewing area, such as a retainer clip (not shown) mounted on the sewing head 12. The groove 54 in the first section 44 of the housing 42 allows the thread T to be removed from the conical aperture 48 without unthreading the needle eye 18.

Numerous alterations of the structure herein disclosed will suggest themselves to those skilled in the art. However, it is to be understood that the present disclosure relates to a preferred embodiment of the invention which is for purposes of illustrations only and not to be construed as a limitation of the invention. All such modifications which do not depart from the spirit of the invention are intended to be included within the scope of the appended claims.

What we claim is:

1. A pneumatic needle threading assist for threading an eye in a sewing machine needle comprising a housing, means for guiding an end of a thread supply to said needle eye comprising said housing being formed with a conical aperture having a smaller end substantially the same size as said needle eye, means for receiving said needle into said needle threading assist comprising said housing being formed with a needle slot transverse to the axis of said conical aperture and located opposite the smaller end thereof, means for supplying an air vacuum to said needle threading assist for urging the end of said thread supply through said needle eye, a groove formed in said housing intersecting said conical aperture along the entire length thereof whereby after thread has passed through said needle eye, said needle threading assist may be removed from the thread, and said housing being formed with a cylindrical thread chamber located at the opposite side of said needle slot from said conical aperture for collecting a quantity of said thread supply having passed through said needle eye, in advance of said air vacuum supplying means, whereby said thread will not collect in said vacuum supplying means, said cylindrical thread chamber having an axis substantially perpendicular to the axis of said conical aperture, and a thread orifice tangentially intersecting said thread chamber and entering said needle slot, said thread orifice being coaxial with said conical aperture and having a size substantially the same as the smaller end of said conical aperture.

2. The pneumatic needle threading assist as set forth in claim 1 in combination with a sewing machine having a needle bar arranged for reciprocatory motion and a thread receiving sewing needle attached to an end of said needle bar.

* * * * *